US012365971B2

(12) United States Patent
Sakamoto et al.

(10) Patent No.: US 12,365,971 B2
(45) Date of Patent: Jul. 22, 2025

(54) HOT-ROLLED WIRE ROD

(71) Applicant: NIPPON STEEL CORPORATION, Tokyo (JP)

(72) Inventors: Masashi Sakamoto, Tokyo (JP); Junichi Kodama, Tokyo (JP); Yoshihiro Daito, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 795 days.

(21) Appl. No.: 17/284,671

(22) PCT Filed: Oct. 16, 2019

(86) PCT No.: PCT/JP2019/040704

§ 371 (c)(1),
(2) Date: Apr. 12, 2021

(87) PCT Pub. No.: WO2020/080415

PCT Pub. Date: Apr. 23, 2020

(65) Prior Publication Data

US 2021/0395868 A1 Dec. 23, 2021

(30) Foreign Application Priority Data

Oct. 16, 2018 (JP) ..... 2018-195045

(51) Int. Cl.
*C22C 38/54* (2006.01)
*C21D 8/06* (2006.01)
(Continued)

(52) U.S. Cl.
CPC ..... *C22C 38/54* (2013.01); *C21D 8/065* (2013.01); *C21D 9/525* (2013.01); *C22C 38/001* (2013.01);
(Continued)

(58) Field of Classification Search
None
See application file for complete search history.

(56) References Cited

U.S. PATENT DOCUMENTS

2009/0229711 A1* 9/2009 Yamasaki ..... C22C 38/02 148/330
2010/0263772 A1 10/2010 Lee
2014/0000767 A1* 1/2014 Yamasaki ..... C22C 38/001 148/333
2018/0087125 A1 3/2018 Ishida et al.

FOREIGN PATENT DOCUMENTS

EP 3533898 A1 * 9/2019 ..... C21D 8/06
JP 2008007856 A * 1/2008
(Continued)

OTHER PUBLICATIONS

English language machine translation of KR-143499-B1. Generated Dec. 12, 2023. (Year: 2023).*
(Continued)

*Primary Examiner* — Brian D Walck
(74) *Attorney, Agent, or Firm* — Greer, Burns & Crain, Ltd.

(57) ABSTRACT

This hot-rolled wire rod includes, as a chemical composition, by mass %: C: 0.90% to 1.10%; Si: 0.50% to 0.80%; Mn: 0.10% to 0.70%; Cr: 0.10% to 0.40%; P: 0.020% or less; S: 0.015% or less; N: 0.0060% or less; O: 0.0040% or less; and a remainder consisting of Fe and impurities, in which Formulas (1) and (2) are satisfied by mass %, the structure of the hot-rolled wire rod consists of pearlite in an area ratio of 95.0% or more and a remainder, and TS, which is a tensile strength in unit of MPa, and TS*, which is determined from the C content, the Si content, and the Cr content, satisfy Formula (3), $$0.50 \leq [Si]+[Cr] \leq 0.90 \quad (1)$$

$$0.40 \leq [Cr]+[Mn] \leq 0.80 \quad (2)$$

$$-50 < TS - TS^* < 50 \quad (3)$$

where the TS* is calculated by Formula (3'), $$TS^* = 1000 \times [C] + 100 \times [Si] + 125 \times [Cr] + 150 \quad (3').$$

5 Claims, 1 Drawing Sheet

(51) Int. Cl.

| | |
|---|---|
| ***C21D 9/52*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/52*** | (2006.01) |

(52) U.S. Cl.

CPC ..... *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/52* (2013.01); *C21D 2211/003* (2013.01)

(56) References Cited

FOREIGN PATENT DOCUMENTS

| | | | | |
|---|---|---|---|---|
| JP | 2011509345 | A | 3/2011 | |
| JP | 2017061740 | A | 3/2017 | |
| KR | 143499 | B1 * | 8/1998 | |
| WO | WO-2018079781 | A1 * | 5/2018 | ..... C21D 8/06 |

OTHER PUBLICATIONS

JIS Z 2244; Vickers hardness test—Test method; (2009); (see present Specification for a concise explanation of relevance).

* cited by examiner

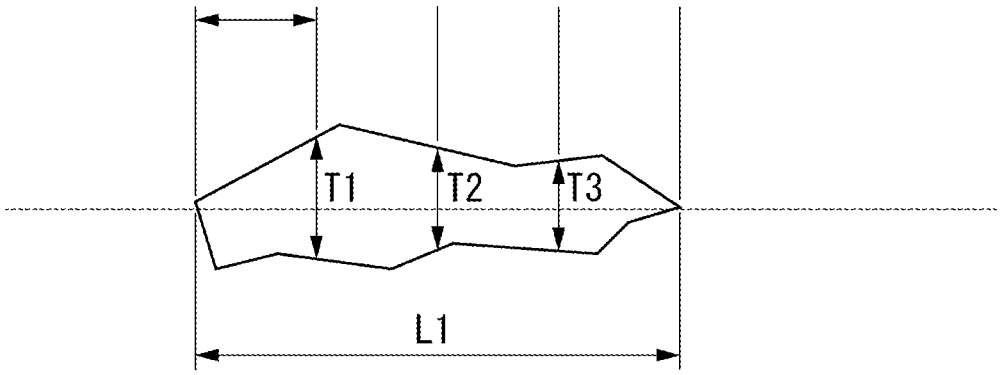
T1
T2
T3
L1

HOT-ROLLED WIRE ROD

This is a National Phase Application filed under 35 U.S.C. § 371, of International Application No. PCT/JP2019/040704, filed Oct. 16, 2019, the contents of which are incorporated by reference.

TECHNICAL FIELD OF THE INVENTION

The present invention relates to a hot-rolled wire rod which is a material for a high strength steel wire (for example, a steel cord, a saw wire and the like) manufactured through a wire-drawing process after rolling. Priority is claimed on Japanese Patent Application No. 2018-195045, filed Oct. 16, 2018, the content of which is incorporated herein by reference.

RELATED ART

A high strength steel wire used for a steel cord, a saw wire, and the like is one of the strongest kinds of steel materials on the market. However, such a high strength steel wire is required to achieve high-strengthening and a reduction in diameter for a reduction in manufacturing costs and differentiation between products.

On the other hand, a steel cord is often used in a state in which a plurality of steel cords are finally twisted and processed (twisting), and even in a case where a saw wire is used in the form of a single wire, the saw wire may be used in a twisted state. Therefore, such a high strength steel wire is required to have not only strength but also ductility.

Such a high strength steel wire is generally manufactured through dry wire-drawing (primary drawing: hereinafter, referred to as direct drawing) a hot-rolled wire rod (hereinafter, referred to as a wire rod) to a predetermined wire diameter, thereafter performing a heat treatment such as patenting and plating thereon, and further performing wet wire-drawing (final wire-drawing before a product: hereinafter, referred to final drawing) thereon. Depending on the diameter of the product and the workability of the wire rod, patenting may be performed once or more during the dry wire-drawing.

In order to meet the requirement of high-strengthening, as the material of the high strength steel wire, high carbon steel, particularly hyper-eutectoid steel containing C (carbon) in an amount equal to or more than that of eutectoid steel has been used. On the other hand, as described above, since the high strength steel wire may be used as a product after being subjected to a process such as twisting, the high strength steel wire also requires ductility to withstand the twisting. Therefore, in a hyper-eutectoid steel wire, it is conceivable to increase the amount of Si and the like as a method for achieving both high-strengthening and high ductility. However, when the amount of Si and the like is increased, although the strength of the steel wire is increased, the strength of the wire rod is also increased, resulting in a decrease in direct drawability (drawability in direct drawing: direct drawability) and ductility.

Regarding such a problem, for example, Patent Document 1 discloses a high carbon steel wire rod and a steel wire having excellent drawability, in which the Si concentration inside pro-eutectoid cementite and the Si concentration inside lamellar ferrite in the wire rod are controlled.

However, the workability of the wire rod described in Patent Document 1 is insufficient, and there is a demand for a wire rod that can be further processed.

Patent Document 2 describes that a pearlite layered structure is refined by appropriately controlling the C content and adding Si and Cr in a total amount of 0.6% to 1.2% in combination, whereby it is possible to obtain a wire rod for drawing having high strength and high ductility by refining the pearlite layered structure.

The level at which the ductility after drawing is actually evaluated in Patent Document 2 is manufactured by lead patenting, and the drawability (direct drawability) of the hot-rolled wire rod is not evaluated. However, since the tensile strength of the wire rod in Patent Document 2 is large, it is considered that the ductility is low.

PRIOR ART DOCUMENT

Patent Document

[Patent Document 1] Japanese Unexamined Patent Application, First Publication No. 2017-61740

[Patent Document 2] Published Japanese Translation No. 2011-509345 of the PCT International Publication

DISCLOSURE OF THE INVENTION

Problems to be Solved by the Invention

In the present invention, in order to solve the above problems, examinations were conducted. That is, an object of the present invention is to provide a wire rod (hot-rolled wire rod), which is a wire rod on the premise that C is contained in an amount more than eutectoid steel in order to obtain high strength or ductility in a steel wire after wire-drawing as a final product and a Si content and a Cr content are predetermined amounts of more, is obtained without performing a heat treatment for reheating after hot rolling (as hot-rolled), and has excellent direct drawability.

Hereinafter, unless otherwise specified, the direct drawability indicates, among kinds of drawability, the drawability in primary wire-drawing performed by dry drawing without performing a heat treatment before performing drawing on a hot-rolled wire rod.

Means for Solving the Problem

The present inventors produced hot-rolled wire rods in which the metallographic structure and tensile strength were controlled under various hot-rolling conditions using hyper-eutectoid steel having a C content of 0.90% to 1.10%. Using these hot-rolled wire rods, the effects of the structure and tensile strength of the wire rods on the mechanical properties of a steel wire were investigated in detail. As a result, with the finding that excellent direct drawability could be obtained by controlling the C content, the Si content, the Cr content, and the Mn content, and controlling the tensile strength to be within a range determined according to a chemical composition, the present invention was reached.

The present invention has been completed based on the above finding, and the gist thereof is as follows.

(1) A hot-rolled wire rod according to an aspect of the present invention includes, as a chemical composition, by mass %: C: 0.90% to 1.10%; Si: 0.50% to 0.80%; Mn: 0.10% to 0.70%; Cr: 0.10% to 0.40%; P: 0.020% or less; S: 0.015% or less; N: 0.0060% or less; O: 0.0040% or less; and a remainder consisting of Fe and impurities, in which Formulas (a) and (b) are satisfied by mass %, the structure of the hot-rolled wire rod consists of pearlite in an area ratio of 95.0% or more and a remainder, and TS, which is the tensile strength (ultimate tensile strength) in unit of MPa, and TS*, which is determined from the C content, the Si content, and the Cr content, satisfy Formula (c), $$0.50 \leq [Si]+[Cr] \leq 0.90 \quad (a)$$

$$0.40 \leq [Cr]+[Mn] \leq 0.80 \quad (b)$$

$$-50 < TS-TS^* < 50 \quad (c)$$

where the TS* is calculated by Formula (c'), $$TS^* = 1000 \times [C]+100 \times [Si]+125 \times [Cr]+150 \quad (c')$$

in Formulas (a), (b) and (c'), [X] is an amount of an element X by mass %.

(2) The hot-rolled wire rod according to (1) may further include, as the chemical composition, one or two or more selected from the group consisting of: Al: 0.003% or less; Ni: 0.50% or less; Co: 1.00% or less; Mo: 0.20% or less; B: 0.0030% or less; and Cu: 0.15% or less.

(3) The hot-rolled wire rod according to (1) or (2) may further include, as the chemical composition, one or two or more selected from the group consisting of: Nb: 0.05% or less; V: 0.05% or less; Ti: 0.05% or less; REM: 0.05% or less; Mg: 0.05% or less; Ca: 0.05% or less; Zr: 0.05% or less; and W: 0.05% or less.

(4) In the hot-rolled wire rod according to any one of (1) to (3), in a case where a range from a surface to a depth of 200 μm is defined as a surface layer part and a range from a center of the wire rod to R/5 when a circle equivalent radius of a cross section perpendicular to a longitudinal direction of the wire rod is R in unit of mm is defined as a central part, HVs, which is a Vickers hardness of the surface layer part, and HVc, which is a Vickers hardness of the central part, may satisfy Formula (d), $$-45 \leq HVs-HVc \leq 0 \quad (d).$$

(5) In the hot-rolled wire rod according to any one of (1) to (4), in a case where a range from a center of the wire rod to R/5 when a circle equivalent radius of a cross section perpendicular to a longitudinal direction of the wire rod is R in unit of mm is defined as a central part, an average thickness of pro-eutectoid cementite may be 0.25 μm or less in the central part.

(6) In the hot-rolled wire rod according to (5), an area ratio of the pro-eutectoid cementite in the structure may be 0.5% or less in the central part.

(7) In the hot-rolled wire rod according to any one of (1) to (6), a wire diameter of the hot-rolled wire rod may be 3.0 to 6.0 mm.

Effects of the Invention

According to the above aspect of the present invention, it is possible to provide a hot-rolled wire rod which contains C in an amount more than eutectoid steel and Si and Cr, is obtained without a heat treatment for reheating after hot rolling, does not cause delamination even with a high true strain, and thus has excellent direct drawability.

BRIEF DESCRIPTION OF THE DRAWINGS

FIG. 1 is a schematic view illustrating a method of measuring the thickness of pro-eutectoid cementite.

EMBODIMENTS OF THE INVENTION

Hereinafter, a hot-rolled wire rod according to an embodiment of the present invention (hereinafter, the wire rod according to the present embodiment) will be described in detail.

First, the elements in steel (chemical composition) of the wire rod according to the present embodiment are as follows. In the following description, the unit of each element is mass % unless otherwise specified.

C: 0.90% to 1.10%

C (carbon) is an essential element for increasing the strength of the hot-rolled wire rod and a steel wire which is to be a product. When the C content is less than 0.90%, the tensile strength of the steel wire of a final product such as a steel cord decreases. Therefore, the C content is set to 0.90% or more. The C content is preferably 0.95% or more, and more preferably 1.00% or more.

On the other hand, when the C content exceeds 1.10%, the amount of pro-eutectoid cementite increases and a wire break occurs frequently. Furthermore, the strength of the hot-rolled wire rod becomes excessively high, resulting in a decrease in drawability such as direct drawability, and a decrease in the ductility of the steel wire after wire-drawing. Therefore, the C content is set to 1.10% or less. The C content is preferably 1.08% or less.

Si: 0.50% to 0.80%

Si (silicon) is an element having an effect of suppressing the generation of pro-eutectoid cementite. In addition, Si is an element having an effect of improving the ductility of the steel wire after wire-drawing. In order to effectively exhibit these actions, the Si content needs to be 0.50% or more. The Si content is preferably 0.55% or more.

On the other hand, when Si is excessively contained, $SiO_2$-based inclusions that are harmful to drawability are likely to be generated, and solid solution strengthening in ferrite is increased, resulting in a decrease in drawability such as direct drawability. Therefore, the Si content is set to 0.80% or less. The Si content is preferably 0.70% or less.

Mn: 0.10% to 0.70%

Mn (manganese) is an element useful for deoxidation and desulfurization. In addition, Mn has an effect of delaying the transformation of austenite into pro-eutectoid cementite or intergranular ferrite, and is therefore a useful element for obtaining a pearlite-based structure. In order to effectively exhibit such an action, the Mn content is set to 0.10% or more.

On the other hand, even if Mn is excessively contained, not only is the above effect saturated, but also a supercooled structure such as bainite and martensite is likely to be generated in a cooling process after hot rolling, and it takes a long time to complete the transformation, which leads to a decrease in productivity and an increase in equipment cost. Therefore, the Mn content is set to 0.70% or less. The Mn content is preferably 0.50% or less.

Cr: 0.10% to 0.40%

Cr (chromium), like Mn, has an effect of delaying the transformation of austenite into pro-eutectoid cementite and intergranular ferrite, and is a useful element for obtaining a pearlite-based structure. In addition, Cr is an element useful for increasing a work hardening rate at the time of wire-drawing by narrowing the lamellar spacing of the pearlite structure and increasing the strength of a steel wire which is to be a product. In order to effectively exhibit this action, the Cr content is set to 0.10% or more.

On the other hand, when the Cr content exceeds 0.40%, not only are these effects saturated, but also hardenability becomes high, and a supercooled structure such as bainite and martensite is likely to be generated in a cooling process after hot rolling or it takes a long time to complete the transformation, which leads to a decrease in productivity and an increase in equipment cost. Therefore, the Cr content is set to 0.40% or less. The Cr content is preferably 0.30% or less.

P: 0.020% or Less

P (phosphorus) is an impurity. When the P content exceeds 0.020%, there is concern that P may segregate at grain boundaries and the drawability may decrease. Therefore, the P content is limited to 0.020% or less. The P content is preferably limited to 0.015% or less. Since the smaller the P content is, the more desirable it is, the lower limit of the P content may be 0%. However, it is technically not easy to set the P content to 0%, and stably setting the P content to less than 0.001% also causes an increase in steelmaking cost. Therefore, the P content may be set to 0.001% or more.

S: 0.015% or Less

S (sulfur) is an impurity. When the S content exceeds 0.015%, there is concern that coarse MnS may be formed and the drawability such as direct drawability may decrease. Therefore, the S content is limited to 0.015% or less. The S content is limited to preferably 0.010% or less, and more preferably 0.008% or less. Since the smaller the S content is, the more desirable it is, the lower limit of the S content may be 0%. However, it is technically not easy to set the S content to 0%, and stably setting the S content to less than 0.001% also causes an increase in steelmaking cost. Therefore, the S content may be set to 0.001% or more.

N: 0.0060% or Less

N is an element that forms a nitride. Since the nitride is hard and does not deform during hot rolling or wire-drawing, the nitride is likely to be the origin of a wire break during the final wire-drawing. In particular, when the N content exceeds 0.0060%, a wire break is likely to occur during the final wire-drawing. Therefore, the N content is set to 0.0060% or less. The N content is preferably 0.0050% or less.

O: 0.0040% or Less

O (oxygen) is an element that easily forms an oxide. Therefore, O is bonded to Al and the like to form oxide-based inclusions and decreases the drawability. In particular, when the O content exceeds 0.0040%, the oxide-based inclusions become coarse and a wire break occurs frequently during the final wire-drawing, resulting in a significant decrease in drawability. Therefore, the O content is limited to 0.0040% or less. The O content is preferably 0.0030% or less.

[Si]+[Cr]: 0.50% to 0.90% ([Si] is Si Content, and [Cr] is Cr Content)

In the wire rod according to the present embodiment, the total amount of Si and Cr is set to 0.50% or more in order to achieve both high-strengthening and high ductility of the steel wire after wire-drawing. When the total amount of both elements is less than 0.50%, these effects cannot be sufficiently obtained. The total amount thereof is preferably 0.60% or more. By this adjustment, pro-eutectoid cementite is adjusted to an extent that pro-eutectoid cementite has no effect on the direct drawability.

On the other hand, when the total amount of Si and Cr exceeds 0.90%, the tensile strength increases excessively and the direct drawability decreases. Therefore, the total amount of Si and Cr is set to 0.90% or less. The total amount of Si and Cr is preferably 0.80% or less.

[Cr]+[Mn]: 0.40% to 0.80% ([Cr] is Cr Content, and [Mn] is Mn Content)

In the wire rod according to the present embodiment, the total amount of Mn and Cr is controlled in order to suppress the generation of pro-eutectoid cementite and intergranular ferrite during hot rolling. When the total amount of both elements is less than 0.40%, these effects cannot be sufficiently obtained. Therefore, the total amount of Mn and Cr is set to 0.40% or more. The total amount of Mn and Cr is preferably 0.45% or more.

On the other hand, when the total content of Mn and Cr exceeds 0.80%, the hardenability becomes excessively high, and a supercooled structure such as bainite and martensite is likely to be generated during hot rolling or it takes a long time to complete the transformation, which leads to a decrease in productivity and an increase in equipment cost. Therefore, the total amount of Mn and Cr is set to 0.80% or less. The total amount of Mn and Cr is more preferably 0.60% or less.

The wire rod according to the present embodiment basically contains the above-mentioned elements, but may further optionally contain one or two or more of the following elements within the ranges described below. However, since the following elements do not necessarily have to be contained, the lower limit thereof includes 0%.

Al: 0.003% or Less

Al may not be contained. Al (aluminum) is very useful as a deoxidizing element, and therefore may be contained in order to utilize its effect.

On the other hand, Al is an element that reacts with O to generate hard oxides such as $Al_2O_3$ and causes a decrease in the drawability of final wire-drawing, such as direct drawability, and a decrease in the ductility of a steel wire. Therefore, the Al content is set to 0.003% or less. The Al content is more preferably 0.002% or less.

Ni: 0.50% or Less

Ni may not be contained. Ni (nickel) has an effect of delaying the transformation of austenite of steel into pro-eutectoid cementite and intergranular ferrite, and is therefore a useful element for obtaining a pearlite-based structure. In addition. Ni is an element that enhances the toughness of a drawn wire rod (steel wire after wire-drawing). Therefore, Ni may be contained. In a case where these effects are obtained, the Ni content is preferably set to 0.10% or more.

On the other hand, when Ni is excessively contained, the hardenability becomes excessive, and a supercooled structure such as bainite and martensite is generated in a cooling process after hot rolling, resulting in a decrease in the direct drawability. Therefore, even in a case where Ni is contained, the Ni content is preferably set to 0.50% or less.

Co: 1.00% or Less

Co may not be contained. Co (cobalt) is an element effective in suppressing the precipitation of pro-eutectoid ferrite in the hot-rolled wire rods. Co is also an effective element for improving the ductility of the steel wire. Therefore, Co may be contained. In a case where the above effect is obtained, the Co content is preferably set to 0.10% or more.

On the other hand, even if Co is excessively contained, the effect is saturated and economically wasteful. Therefore, even in a case where Co is contained, the Co content is preferably set to 1.00% or less.

Mo: 0.20% or Less

Mo may not be contained. Mo (molybdenum) has an effect of delaying the transformation of austenite of steel into pro-eutectoid cementite and intergranular ferrite, and is therefore a useful element for obtaining a pearlite-based structure. Therefore, Mo may be contained. In a case where the above effect is obtained, the Mo content is preferably set to 0.03% or more.

On the other hand, when the Mo content exceeds 0.20%, the hardenability becomes excessive, and a supercooled structure such as bainite and martensite is generated in a cooling process after hot rolling. Therefore, even in a case where Mo is contained, the Mo content is preferably set to 0.20% or less. The Mo content is more preferably 0.15% or less.

B: 0.0030% or Less

B may not be contained. B (boron) is concentrated at grain boundaries, and is therefore an element effective for suppressing the generation of pro-eutectoid ferrite. Therefore, B may be contained. In a case where the above effect is obtained, the B content is preferably set to 0.0002% or more. The B content is more preferably 0.0005% or more.

On the other hand, when B is excessively contained, carbides such as $Fe_{23}(CB)_6$ are formed in austenite, and the drawability of direct drawing and final wire-drawing decreases. Therefore, even in a case where B is contained, the B content is preferably set to 0.0030% or less. The B content is more preferably 0.0020% or less.

Cu: 0.15% or Less

Cu may not be contained. Cu (copper) is an element that contributes to high-strengthening of the steel wire obtained after wire-drawing by precipitation hardening or the like. Therefore, Cu may be contained. In a case where the above effect is obtained, the Cu content is preferably set to 0.05% or more.

On the other hand, excessive inclusion of Cu causes intergranular embrittlement and generates defects. Therefore, even in a case where Cu is contained, the Cu content is preferably set to 0.15% or less. The Cu content is more preferably 0.13% or less.

The steel of the present invention contains the above elements, and the remainder substantially formed of Fe and impurities. However, Nb, V, Ti, REM, Mg, Ca, Zr, and W may be contained as long as the effect of the wire rod according to the present embodiment is not impaired. When the amount of any of these elements is 0.05% or less, the effects of the wire rod according to the present embodiment are not impaired.

Next, the structure (microstructure) of the wire rod according to the present embodiment will be described.

[Consisting of Pearlite in Area Ratio of 95.0% or More and Remainder]

The wire rod according to the present embodiment consists of pearlite in an area ratio of 95.0% or more and a remainder. The remainder is any one or two or more of pro-eutectoid cementite, intergranular ferrite, bainite or martensite, and retained austenite. There is a possibility that pro-eutectoid cementite, intergranular ferrite, bainite, martensite, and retained austenite may be a propagation path of fracture, and an increase in the area ratio thereof causes a decrease in direct drawability. Therefore, the area ratio of pearlite is set to 95.0% or more, and the area ratio of the remainder is set to 5.0% or less. The area ratio of pearlite is preferably set to 97.0% or more. The area ratio of pearlite may be 100%. However, it is difficult to completely suppress the generation of pro-eutectoid cementite, intergranular ferrite, bainite, martensite, and retained austenite in the composition system of the wire rod according to the present embodiment. In a case where the generation of these structures is to be completely suppressed, an extremely excellent cooling capacity is required, resulting in an increase in equipment cost. Furthermore, due to an increase in tensile strength and the like, the direct drawability decreases and the load at the time of wire-drawing increases, which may results in increased cost in secondary work. Therefore, the area ratio of pearlite may be 99.0% or less.

$$[-50<TS-TS^*<50]$$

In the wire rod according to the present embodiment, a tensile strength TS (MPa) obtained by a tensile test is controlled within a range specified by Formula (3). TS* represented by TS of Formula (3) is an appropriate value of the tensile strength according to the chemical composition (particularly the C content, the Si content, and the Cr content) calculated by Formula (3'). When TS−TS* is within a range smaller than ±50 (MPa), the direct drawability is excellent even if the Si content is high.

When the tensile strength TS is smaller than TS* by 50 MPa or more, the direct drawability decreases. It is considered that this is because the grain size becomes coarse and lamellar cementite thickens in the structure. On the other hand, when the average tensile strength TS is larger than TS* by 50 MPa or more, the work hardening rate at the time of wire-drawing increases, the tensile strength of the steel wire increases, the ductility tends to decrease, and the direct drawability decreases. In addition, there is a concern that the load on a die and a wire-drawing machine may increase and the manufacturing cost may increase.

TS−TS* is preferably in a range of ±45 (MPa), and more preferably in a range of ±40 (MPa).

$$-50<TS-TS^*<50 \quad (3)$$

$$TS^* \text{ (MPa)}=1000\times[C]+100\times[Si]+125\times[Cr]+150 \quad (3)$$

In Formula (3'), [C] indicates the C content (mass %), [Si] indicates the Si content (mass %), and [Cr] indicates the Cr content (mass %).

In the remainder in microstructure, pro-eutectoid cementite has a large effect on drawability, as it can cause a wire break. However, even in a case where pro-eutectoid cementite is present (in a case where the area ratio exceeds 0%), as long as a small amount of pro-eutectoid cementite is precipitated and the shape thereof such as thickness is controlled, the effect on direct drawability is small. Specifically, when a circle equivalent radius of a cross section perpendicular to a longitudinal direction of the wire rod is indicated as R (mm), the area ratio of pro-eutectoid cementite in a range (hereinafter, sometimes referred to as a central part) from the center to R/5 is 0.50% or less and the average thickness of the pro-eutectoid cementite is 0.25 μm or less, which improves the direct drawability. More preferably, the area ratio of the pro-eutectoid cementite is 0.40% or less, and the thickness of the pro-eutectoid cementite is 0.20 μm or less. When the area ratio and the thickness of pro-eutectoid cementite are larger than the specified values, defects at the time of wire-drawing also increase, which easily causes a wire break. In the present embodiment, since there are cases where the area ratio of pro-eutectoid cementite is 0%, the lower limit of the thickness of the pro-eutectoid cementite is 0 μm, but the lower limit of the thickness of pro-eutectoid cementite may exceed 0 μm.

$$[-45\leq HVs-HVc\leq 0]$$

In the wire rod according to the present embodiment, by making the hardness of a surface layer part lower than the hardness of the central part, the drawability is further improved. On the other hand, when the hardness of the surface layer part is made too low, non-uniformity increases, decarburization and the like are observed, and the drawability decreases. Therefore, it is preferable to control the Vickers hardness HVs of a range (surface layer part) from the surface to a depth of 0.2 mm and the Vickers hardness HVc of a range (central part) from the center to R/5 when the circle equivalent radius of the cross section perpendicular to the longitudinal direction of the wire rod is indicated as R (mm) so that Formula (4) is satisfied. By setting HVs−HVc in the range specified in Formula (4), superior direct drawability can be secured.

$$-45 \leq HVs - HVc < 0 \quad (4)$$

The wire diameter (2R) of the hot-rolled wire rod affects the cooling rate after coiling, and as a result, affects the metallographic structure, tensile strength, and the like. When the diameter (wire diameter) of the hot-rolled wire rod exceeds 6.0 mm, the cooling rate at the center of the wire rod tends to be slow, and pro-eutectoid cementite is likely to be generated, so that there is concern that the area ratio of pearlite may decrease. On the other hand, when the diameter of the hot-rolled wire rod is less than 3.0 mm, it is difficult to perform manufacturing, the production efficiency is lowered, and there is a possibility that the cost of the hot-rolled wire rod may increase. Therefore, the wire diameter is preferably set to 3.0 mm or more and 6.0 mm or less.

Next, a method of measuring each of the area ratios of the structures contained in the wire rod according to the present embodiment, the average thickness of pro-eutectoid cementite, the tensile strength, and the hardnesses of the surface layer part and the central part will be described.

The area ratios of pro-eutectoid cementite, intergranular ferrite, bainite and martensite, and retained austenite are measured as follows.

The wire rod after hot rolling is cut, embedded in a resin so that the cross section perpendicular to the length direction can be observed, and then polished with abrasive paper or alumina abrasive grains to obtain a mirror-finished sample. The mirror-finished sample is corroded with a 3% initial solution, and then observed and photographed using a scanning electron microscope (SEM). The entire cross section is photographed at a magnification of 2,000-fold to 5,000-fold so that the area of the observed visual field is 0.02 $mm^2$ or more, a transparent sheet or the like is placed on the photographed image. Pro-eutectoid cementite, bainite, intergranular ferrite, martensite, and retained austenite are individually painted, and then the area of the painted point is measured using image analysis software such as particle analysis software, whereby the area ratios of pro-eutectoid cementite, bainite, intergranular ferrite and martensite, and retained austenite can be measured. The measurement is basically performed at a magnification of 2,000-fold. However, in a case where it cannot be determined at a magnification of 2,000-fold whether or not the measurement position is any of pro-eutectoid cementite, bainite, intergranular ferrite and martensite, and retained austenite, the observation may be performed at a higher magnification to determine which structure it is. However, in that case, continuous photographing is performed so that the visual field is the same as that of 2,000-fold.

The area ratio of pearlite is obtained by subtracting the sum of the area ratios of pro-eutectoid cementite, bainite, ferrite, martensite, and retained austenite measured above from the total (100%).

The thickness of pro-eutectoid cementite is measured by preparing an observation sample in the same manner as the measurement of the area ratio and using an image photographed by SEM. Five visual fields are photographed at a magnification of 2,000-fold at the central part of the wire rod (a range from the center to R/5 from the center). Among the photographs, regarding 10 points from pro-eutectoid cementite having a large major axis, three lines perpendicular to the major axis direction that divide the major axis of the pro-eutectoid cementite into four equal parts are drawn, and the average value of the thicknesses of the three points measured on the lines is taken as the thickness of the pro-eutectoid cementite. That is, in FIG. 1, regarding the thickness of the pro-eutectoid cementite, the average of T1, T2, and T3 is defined as the thickness of the pro-eutectoid cementite. In the measurement of the thickness of the pro-eutectoid cementite, in a case where the measurement point is the branch point of cementite, the point is not included in the average. In a case where the number of points of pro-eutectoid cementite is less than 10, the average value is calculated using only the measured points. However, in a case where the measurement is not easy at a magnification of 2,000-fold, the thickness may be measured by observing the target pro-eutectoid cementite at a higher magnification (for example, 5,000-fold).

Regarding the tensile strength TS (MPa), eight tensile test pieces having a length of 400 mm are continuously taken from a part of a coil of the hot-rolled wire rod excluding an unsteady portion that is cut off in ordinary products and are subjected to a tensile test. The average value of tensile strengths obtained from the result of the tensile test is taken as the tensile strength TS.

For the measurement of the hardness, two rings are taken from the part of the coil of the hot-rolled wire rod excluding the unsteady portion, four test pieces having a length of about 15 mm are taken from one ring divided at four equal intervals, each of the test pieces is embedded in a resin so that a cross section perpendicular to the longitudinal direction is revealed and polished with alumina, and a surface layer part and a central part of each of the cross sections are evaluated by a Vickers hardness test.

The Vickers hardness of the surface layer part is measured at a position 30 μm from the surface, which is a representative position of the surface layer part, at four points per cross section. In addition, the Vickers hardness of the central part is measured in the region from the center to R/5 when the radius of the wire rod is indicated as R (mm), at four points. The same operation is performed on all the cross sections described above, the average of the values measured in the surface layer part is defined as the Vickers hardness HVs of the surface layer part, and the average of the values measured in the central part is defined as the Vickers hardness HVc of the central part.

Next, a preferable manufacturing method of the wire rod according to the present embodiment will be described. The manufacturing method described below is an example, and is not limited to the following procedure and method, and any method can be adopted as long as the hot-rolled wire rod of the present embodiment can be obtained.

A material to be subjected to hot rolling may be manufactured under normal manufacturing conditions. For example, a steel having the above-mentioned chemical composition is cast, and the obtained cast piece is bloomed into a steel piece (a steel piece before wire rod rolling, generally called a billet) having a size suitable for wire rod rolling, and can be subjected to hot rolling.

The obtained steel piece is subjected to hot rolling to obtain a hot-rolled wire rod.

During the hot rolling, it is preferable to heat the steel piece to 950° C. to 1150° C., and control a finish rolling start temperature to 800° C. or higher and 950° C. or lower. A rolling temperature is measured by a radiation-type thermometer and means the surface temperature of the steel material. Although the wire rod after finish rolling rises above the finish rolling start temperature due to deformation heating, it is preferable to control a coiling temperature to 800° C. or higher and 940° C. or lower. When the coiling temperature is lower than 800° C., the particle size of austenite becomes finer, pro-eutectoid cementite and intergranular ferrite are likely to be precipitated, and the mechanical scale peelability is also lowered. On the other hand, when the coiling temperature exceeds 940° C., the particle size of austenite becomes excessively large, the tensile strength increases and the area of bainite or the like increases, so that the direct drawability decreases. The coiling temperature is more preferably 830° C. or higher and 920° C. or lower, and even more preferably 850° C. or higher and 900° C. or lower.

The hot-rolled wire rod is transformed from austenite into pearlite during cooling after coiling. After the coiling, cooling is performed at an average cooling rate 1 up to 660° C. set to 5° C./s or more and 20° C./s or less, an average cooling rate 2 from 660° C. to 610° C. set to 3° C./s or more and 5° C./s or less, and an average cooling rate 3 from 610° C. to 450° C. set to 8° C./s or higher.

When the average cooling rate 1 is less than 5° C./s, it is difficult to suppress pro-eutectoid cementite; on the other hand, when the cooling rate exceeds 20° C./s, structures such as bainite are generated in a large amount and there is concern that the area ratio of pearlite may decrease. In addition to the excessive capacity, there is a high possibility that mechanical scale peelability may decrease, and the cost of cooling equipment may increase. The average cooling rate 1 is preferably 6° C./s or more and 12° C./s or less.

When the average cooling rate 2 exceeds 5° C./s, the transformation temperature decreases, the lamellar spacing is excessively refined, and the tensile strength becomes excessively high. On the other hand, when the average cooling rate 2 is less than 3° C./s, the tensile strength becomes too low and the drawability decreases. The average cooling rate 2 is preferably 3° C./s or more and less than 5° C./s.

Furthermore, when the average cooling rate 3 is less than 8° C./s, cementite in pearlite is divided, and the area ratio of pearlite decreases, or TS becomes excessively low, resulting in a decrease in the direct drawability. The upper limit of the average cooling rate 3 is not particularly limited, but may be set to 30° C./s or less because an excessive cooling capacity may cause an increase in cost.

The temperature of the hot-rolled wire rod during the manufacturing is the temperature measured by a radiation-type thermometer.

By having the chemical composition of the present embodiment and adjusting the manufacturing conditions as described above, the structure, tensile strength, and the like of the wire rod can be within the ranges of the present embodiment.

EXAMPLES

Hereinafter, the present invention will be described in more detail with reference to examples of the wire rod according to the present invention. However, the present invention is not limited to the following examples as a matter of course, and can be embodied with appropriate modifications to the extent that the modifications can be adapted to the gist described above and below, all of which are within the technical scope of the present invention.

Tables 1A to 1C show steel compositions (chemical composition), Tables 2A and 2B show hot rolling conditions, and Tables 3A, 3B, and 3C show the results of the evaluation of the structure and mechanical properties such as tensile strength and hardness of hot-rolled wire rods and the evaluation of tensile properties and direct drawability of drawn wire rods (steel wires).

In Table 2A and Table 2B;

Average cooling rate 1: Average cooling rate up to 660° C. after coiling,

Average cooling rate 2: Average cooling rate from 660° C. to 610° C., and

Average cooling rate 3: Average cooling rate from 610° C. to 450° C.

In Tables 1A to 3C, numerical values outside the range of the present invention are underlined.

Levels A1 to A38 are present invention examples. Levels B1 to B18 are examples in which either the composition or the hot rolling conditions is outside the appropriate range, and the structure and strength range of the hot-rolled wire rod are outside the appropriate range of the present invention.

TABLE 1A

| | Composition (mass %): remainder consisting of Fe and impurities | | | | | | | | | | | | | | | | |
|---|---|---|---|---|---|---|---|---|---|---|---|---|---|---|---|---|---|
| Level | C | Si | Mn | P | S | Cr | N | O | Al | Ni | Co | Mo | B | Cu | Others | Si + Cr | Cr + Mn |
| A1 | 0.92 | 0.51 | 0.31 | 0.008 | 0.008 | 0.19 | 0.0033 | 0.0012 | 0.001 | — | — | — | — | — | — | 0.70 | 0.50 |
| A2 | 0.96 | 0.52 | 0.30 | 0.009 | 0.008 | 0.20 | 0.0041 | 0.0014 | — | — | — | — | — | — | — | 0.72 | 0.50 |
| A3 | | | | | | | | | | | | | | | | | |
| A4 | | | | | | | | | | | | | | | | | |
| A5 | | | | | | | | | | | | | | | | | |
| A6 | 0.97 | 0.55 | 0.62 | 0.008 | 0.008 | 0.11 | 0.0037 | 0.0012 | 0.002 | — | — | — | — | — | — | 0.66 | 0.73 |
| A7 | 1.00 | 0.53 | 0.30 | 0.011 | 0.007 | 0.15 | 0.0045 | 0.0017 | 0.001 | — | — | — | — | — | — | 0.68 | 0.45 |
| A8 | | | | | | | | | | | | | | | | | |
| A9 | | | | | | | | | | | | | | | | | |
| A10 | | | | | | | | | | | | | | | | | |
| A11 | 1.02 | 0.51 | 0.32 | 0.009 | 0.008 | 0.21 | 0.0042 | 0.0021 | — | — | — | — | — | — | — | 0.72 | 0.53 |
| A12 | 1.01 | 0.71 | 0.53 | 0.012 | 0.009 | 0.11 | 0.0029 | 0.0012 | 0.001 | — | — | — | — | — | — | 0.82 | 0.64 |
| A13 | 0.96 | 0.55 | 0.28 | 0.008 | 0.008 | 0.30 | 0.0045 | 0.0015 | 0.001 | — | — | — | — | — | — | 0.85 | 0.58 |
| A15 | 1.08 | 0.51 | 0.35 | 0.010 | 0.009 | 0.11 | 0.0040 | 0.0020 | 0.001 | — | — | — | — | — | — | 0.62 | 0.46 |
| A17 | 1.07 | 0.51 | 0.30 | 0.008 | 0.008 | 0.20 | 0.0036 | 0.0018 | — | — | — | — | — | — | — | 0.71 | 0.50 |
| A18 | | | | | | | | | | | | | | | | | |
| A19 | | | | | | | | | | | | | | | | | |
| A20 | 1.00 | 0.55 | 0.28 | 0.012 | 0.008 | 0.14 | 0.0052 | 0.0018 | 0.001 | 0.20 | — | — | — | — | — | 0.69 | 0.42 |
| A21 | 1.03 | 0.53 | 0.31 | 0.010 | 0.005 | 0.19 | 0.0044 | 0.0025 | 0.002 | — | 0.75 | — | — | — | — | 0.72 | 0.50 |

TABLE 1A-continued

| Level | Composition (mass %): remainder consisting of Fe and impurities | | | | | | | | | | | | | | | | |
|---|---|---|---|---|---|---|---|---|---|---|---|---|---|---|---|---|---|
| | C | Si | Mn | P | S | Cr | N | O | Al | Ni | Co | Mo | B | Cu | Others | Si + Cr | Cr + Mn |
| A22 | 1.02 | 0.52 | 0.18 | 0.011 | 0.008 | 0.28 | 0.0036 | 0.0010 | 0.001 | — | — | 0.14 | — | — | — | 0.80 | 0.46 |
| A23 | 1.00 | 0.56 | 0.50 | 0.008 | 0.007 | 0.18 | 0.0039 | 0.0019 | 0.001 | — | — | — | 0.0015 | — | — | 0.74 | 0.68 |
| A24 | 1.09 | 0.53 | 0.29 | 0.009 | 0.008 | 0.21 | 0.0041 | 0.0017 | 0.001 | — | — | 0.03 | 0.0011 | — | — | 0.74 | 0.50 |
| A25 | 0.98 | 0.55 | 0.35 | 0.008 | 0.008 | 0.14 | 0.0028 | 0.0036 | 0.002 | — | — | — | — | 0.13 | — | 0.69 | 0.49 |
| A26 | 1.05 | 0.55 | 0.31 | 0.008 | 0.009 | 0.21 | 0.0035 | 0.0011 | 0.001 | — | — | — | — | — | — | 0.76 | 0.52 |
| A27 | 1.01 | 0.56 | 0.29 | 0.010 | 0.008 | 0.22 | 0.0036 | 0.0015 | 0.002 | — | — | — | — | — | — | 0.78 | 0.51 |

TABLE 1B

| Level | Composition (mass %): remainder consisting of Fe and impurities | | | | | | | | | | | | | | | | |
|---|---|---|---|---|---|---|---|---|---|---|---|---|---|---|---|---|---|
| | C | Si | Mn | P | S | Cr | N | O | Al | Ni | Co | Mo | B | Cu | Others | Si + Cr | Cr + Mn |
| A28 | 1.07 | 0.51 | 0.30 | 0.008 | 0.008 | 0.20 | 0.0036 | 0.0018 | — | — | — | — | — | — | — | 0.71 | 0.50 |
| A29 | | | | | | | | | | | | | | | — | | |
| A30 | 1.03 | 0.53 | 0.22 | 0.007 | 0.009 | 0.20 | 0.0038 | 0.0031 | 0.002 | — | — | — | — | — | Ca: 0.03, W: 0.05 | 0.73 | 0.42 |
| A31 | 1.09 | 0.55 | 0.41 | 0.008 | 0.007 | 0.31 | 0.0039 | 0.0017 | — | — | — | — | — | — | Mg: 0.04 | 0.86 | 0.72 |
| A32 | 1.03 | 0.54 | 0.32 | 0.008 | 0.007 | 0.32 | 0.0033 | 0.0020 | 0.001 | — | — | — | — | — | Ca: 0.04 | 0.86 | 0.64 |
| A33 | 1.02 | 0.61 | 0.32 | 0.009 | 0.007 | 0.22 | 0.0041 | 0.0031 | 0.002 | — | — | — | — | — | Nb: 0.05 | 0.83 | 0.54 |
| A34 | 1.02 | 0.55 | 0.41 | 0.008 | 0.009 | 0.25 | 0.0030 | 0.0025 | 0.001 | — | — | — | — | — | V: 0.05 | 0.80 | 0.66 |
| A35 | 1.05 | 0.51 | 0.32 | 0.007 | 0.007 | 0.15 | 0.0025 | 0.0018 | 0.001 | — | — | — | — | — | Ti: 0.04 | 0.66 | 0.47 |
| A36 | 1.04 | 0.71 | 0.41 | 0.009 | 0.008 | 0.12 | 0.0026 | 0.0019 | — | — | — | — | — | — | REM: 0.05 | 0.83 | 0.53 |
| A37 | 1.03 | 0.56 | 0.30 | 0.011 | 0.009 | 0.21 | 0.0031 | 0.0021 | — | — | — | — | — | — | Zr: 0.04 | 0.77 | 0.51 |
| A38 | 1.05 | 0.51 | 0.32 | 0.007 | 0.007 | 0.15 | 0.0033 | 0.0025 | 0.003 | — | — | — | — | — | W: 0.05 | 0.66 | 0.47 |

TABLE 1C

| Level | Composition (mass %): remainder consisting of Fe and impurities | | | | | | | | | | | | | | | | |
|---|---|---|---|---|---|---|---|---|---|---|---|---|---|---|---|---|---|
| | C | Si | Mn | P | S | Cr | N | O | Al | Ni | Co | Mo | B | Cu | Others | Si + Cr | Cr + Mn |
| B1 | 1.17 | 0.51 | 0.32 | 0.007 | 0.005 | 0.20 | 0.0035 | 0.0015 | 0.001 | — | — | — | — | — | — | 0.71 | 0.52 |
| B2 | 1.06 | 0.40 | 0.31 | 0.007 | 0.006 | 0.31 | 0.0035 | 0.0015 | 0.001 | — | — | — | — | — | — | 0.71 | 0.62 |
| B4 | 0.99 | 0.40 | 0.30 | 0.010 | 0.007 | 0.20 | 0.0038 | 0.0012 | 0.002 | — | — | — | — | — | — | 0.60 | 0.50 |
| B5 | 1.01 | 0.98 | 0.31 | 0.008 | 0.008 | 0.22 | 0.0044 | 0.0022 | 0.002 | — | — | — | — | — | — | 1.20 | 0.53 |
| B6 | 0.99 | 0.52 | 1.10 | 0.009 | 0.009 | 0.21 | 0.0039 | 0.0018 | 0.002 | — | — | — | — | — | — | 0.73 | 1.31 |
| B7 | 1.06 | 0.61 | 0.30 | 0.010 | 0.006 | 0.48 | 0.0035 | 0.0010 | 0.001 | — | — | — | — | — | — | 1.09 | 0.78 |
| B8 | 0.98 | 0.78 | 0.28 | 0.008 | 0.008 | 0.28 | 0.0037 | 0.0012 | 0.002 | — | — | — | — | — | — | 1.06 | 0.56 |
| B9 | 1.04 | 0.55 | 0.72 | 0.009 | 0.008 | 0.31 | 0.0039 | 0.0016 | 0.001 | — | — | — | — | — | — | 0.86 | 1.03 |
| B10 | 1.03 | 0.51 | 0.63 | 0.010 | 0.007 | 0.04 | 0.0042 | 0.0019 | 0.001 | — | — | — | — | — | — | 0.55 | 0.67 |
| B11 | 1.05 | 0.50 | 0.13 | 0.012 | 0.006 | 0.21 | 0.0049 | 0.0020 | 0.001 | — | — | — | — | — | — | 0.71 | 0.34 |
| B12 | 0.95 | 0.51 | 0.30 | 0.008 | 0.007 | 0.21 | 0.0036 | 0.0018 | 0.003 | — | — | — | — | 0.19 | — | 0.72 | 0.51 |
| B14 | 1.07 | 0.51 | 0.30 | 0.008 | 0.008 | 0.20 | 0.0033 | 0.0018 | 0.001 | — | — | — | — | — | — | 0.71 | 0.50 |
| B16 | | | | | | | | | | | | | | | | | |
| B17 | | | | | | | | | | | | | | | | | |
| B18 | 1.01 | 0.45 | 0.30 | 0.008 | 0.008 | 0.11 | 0.0033 | 0.0017 | — | — | — | — | — | — | — | 0.56 | 0.41 |

In any of the present examples and the comparative examples, in rolling, a billet was first heated to 1000° C. to 1150° C. in a heating furnace, thereafter rolled while controlling the finish rolling start temperature and the steel temperature raised due to deformation heating in finish rolling as shown in Tables 2A and 2B, and was subjected to hot rolling at the coiling temperature at which a ring shape was formed, the cooling rate (cooling rate 1) up to 660° C. after coiling, the cooling rate (cooling rate 2) from 660° C. to 610° C., and the cooling rate (cooling rate 3) from 610° C. to 450° C. under the conditions shown in Tables 2A and 2B. Tables 2A and 2B also show the wire diameters of the hot-rolled wire rods. The temperature of the hot-rolled wire rod after coiling was measured at a point where the rings overlapped (dense part).

TABLE 2A

| Level | Hot rolling conditions | | | | | | Note |
|---|---|---|---|---|---|---|---|
| | Wire diameter (mm) | Finish rolling start temperature (° C.) | Coiling temperature (° C.) | Average cooling rate 1 (° C./s) | Average cooling rate 2 (° C./s) | Average cooling rate 3 (° C./s) | |
| A1 | 5.5 | 843 | 891 | 6 | 4 | 8 | Present Invention Example |
| A2 | 4.5 | 862 | 912 | 18 | 5 | 9 | Present Invention Example |
| A3 | 5.5 | 821 | 843 | 8 | 4 | 11 | Present Invention Example |
| A4 | 5.5 | 857 | 888 | 8 | 3 | 11 | Present Invention Example |
| A5 | 5.5 | 905 | 871 | 6 | 3 | 9 | Present Invention Example |
| A6 | 5.0 | 843 | 889 | 7 | 4 | 9 | Present Invention Example |
| A7 | 5.5 | 889 | 902 | 7 | 3 | 8 | Present Invention Example |
| A8 | 5.0 | 820 | 926 | 8 | 5 | 9 | Present Invention Example |
| A9 | 4.5 | 826 | 846 | 9 | 4 | 10 | Present Invention Example |
| A10 | 3.8 | 862 | 889 | 13 | 4 | 12 | Present Invention Example |
| A11 | 5.5 | 931 | 875 | 8 | 4 | 9 | Present Invention Example |
| A12 | 5.5 | 855 | 858 | 5 | 4 | 9 | Present Invention Example |
| A13 | 5.5 | 846 | 891 | 6 | 3 | 8 | Present Invention Example |
| A15 | 5.5 | 864 | 908 | 7 | 4 | 9 | Present Invention Example |
| A17 | 5.5 | 852 | 831 | 7 | 4 | 9 | Present Invention Example |
| A18 | 5.0 | 823 | 884 | 7 | 3 | 8 | Present Invention Example |
| A19 | 3.8 | 854 | 901 | 15 | 3 | 11 | Present Invention Example |
| A20 | 5.5 | 892 | 889 | 8 | 4 | 11 | Present Invention Example |
| A21 | 5.5 | 911 | 911 | 8 | 3 | 12 | Present Invention Example |
| A22 | 5.5 | 923 | 890 | 8 | 3 | 8 | Present Invention Example |
| A23 | 5.5 | 906 | 886 | 6 | 3 | 9 | Present Invention Example |
| A24 | 5.5 | 885 | 881 | 6 | 3 | 9 | Present Invention Example |
| A25 | 5.5 | 895 | 883 | 8 | 4 | 10 | Present Invention Example |
| A26 | 5.5 | 856 | 814 | 6 | 3 | 8 | Present Invention Example |
| A27 | 5.0 | 879 | 893 | 6 | 4 | 10 | Present Invention Example |
| A28 | 5.5 | 830 | 790 | 5 | 7 | 9 | Present Invention Example |
| A29 | 5.5 | 835 | 831 | 4 | 3 | 9 | Present Invention Example |
| A30 | 4.0 | 844 | 900 | 13 | 4 | 10 | Present Invention Example |
| A31 | 6.5 | 827 | 817 | 5 | 3 | 11 | Present Invention Example |
| A32 | 5.5 | 850 | 905 | 7 | 4 | 10 | Present Invention Example |
| A33 | 5.5 | 842 | 894 | 6 | 3 | 8 | Present Invention Example |
| A34 | 5.5 | 861 | 865 | 6 | 3 | 10 | Present Invention Example |
| A35 | 5.5 | 855 | 877 | 7 | 4 | 11 | Present Invention Example |
| A36 | 5.5 | 872 | 912 | 7 | 4 | 9 | Present Invention Example |
| A37 | 5.5 | 872 | 915 | 7 | 4 | 9 | Present Invention Example |
| A38 | 5.5 | 861 | 889 | 7 | 4 | 10 | Present Invention Example |

TABLE 2B

| Level | Hot rolling conditions | | | | | | Note |
|---|---|---|---|---|---|---|---|
| | Wire diameter (mm) | Finish rolling start temperature (° C.) | Coiling temperature (° C.) | Average cooling rate 1 (° C./s) | Average cooling rate 2 (° C./s) | Average cooling rate 3 (° C./s) | |
| B1 | 5.5 | 897 | 843 | 7 | 4 | 10 | Comparative Example |
| B2 | 5.5 | 874 | 863 | 6 | 3 | 9 | Comparative Example |
| B4 | 5.0 | 856 | 886 | 8 | 5 | 12 | Comparative Example |
| B5 | 5.5 | 832 | 905 | 9 | 4 | 10 | Comparative Example |
| B6 | 5.5 | 885 | 894 | 8 | 5 | 10 | Comparative Example |
| B7 | 5.5 | 903 | 915 | 9 | 4 | 10 | Comparative Example |
| B8 | 5.5 | 875 | 899 | 8 | 4 | 11 | Comparative Example |
| B9 | 5.5 | 869 | 893 | 9 | 4 | 10 | Comparative Example |
| B10 | 5.5 | 832 | 859 | 7 | 3 | 9 | Comparative Example |
| B11 | 5.5 | 819 | 854 | 6 | 4 | 9 | Comparative Example |
| B12 | 5.5 | 865 | 861 | 9 | 4 | 10 | Comparative Example |
| B14 | 5.5 | 844 | 832 | 8 | 2 | 9 | Comparative Example |
| B16 | 5.5 | 904 | 880 | 22 | 4 | 10 | Comparative Example |
| B17 | 5.5 | 903 | 895 | 8 | 3 | 6 | Comparative Example |
| B18 | 5.5 | 890 | 895 | 7 | 4 | 10 | Comparative Example |

The area ratio of pro-eutectoid cementite, the area ratio of intergranular ferrite, bainite, martensite, and retained austenite, and the area ratio of pearlite of the hot-rolled wire rod were evaluated by the above-described method. In any of the present invention examples and the comparative examples, the structure was a composite structure containing pearlite and a remainder consisting of one or two or more of pro-eutectoid cementite, intergranular ferrite, bainite and martensite, and retained austenite.

Regarding the tensile properties, five rings were taken from each of a coil front portion (a place on the tail end side by 50 rings from a portion at which the coiling temperature reached a predetermined temperature) and a coil tail portion (a place on the tip end side by 100 rings from the tail end) from the coil of the hot-rolled wire rod, eight samples were taken at equal intervals from each ring, that is, a total of 80 samples were taken, and subjected to a test. The average of the 80 samples was taken as the average tensile strength TS of the hot-rolled wire rod. The tensile test was conducted with a sample length of 400 mm, a crosshead speed of 10 mm/min, and a jig spacing of 200 mm.

Regarding the measurement of the hardness, one ring was continuously taken from each of the points from which the samples of the tensile test in the coil of the hot-rolled wire rod were taken for both the front portion and the tail portion, and the Vickers hardness HVs of the surface layer part and the Vickers hardness HVc of the central part were measured according to the above-described method. The load at the time of the measurement of the hardness was 50 g for the evaluation, and further, the measurement was performed by separating an indentation size by 5 times or more so that there was no mutual effect. In addition, a method of measuring the hardness and the like were based on the method described in JIS Z 2244: 2009 for wire rods.

<Drawability (Direct Drawability)>

Using the hot-rolled wire rod obtained as described above, wire-drawing (dry drawing) was performed without performing a patenting treatment. As for samples for the wire-drawing, 15 rings were continuously taken from the places from which the samples of the tensile test and the hardness test were taken in the tail portion of the hot-rolled wire rod. As a pretreatment for the dry drawing, scale was removed by pickling, thereafter a lime film treatment was performed, and drawing was performed at a reduction of 17% to 23% per pass. A twisting test was conducted using the obtained drawn wire rod.

In the twisting test, when the diameter of the sample was indicated as d (mm), with a length between jigs of 100×d (mm), twisting was applied until a fracture had occurred while applying a load of 1% of the tensile strength of each sample. This test was conducted three times each, and the true strain of the drawn wire rod at which delamination occurred was evaluated. In the present invention, those having a true strain of 2.1 or more when delamination occurred were determined to have good direct drawability. Regarding the tensile strength of the steel wire, the tensile test was conducted three times each by the above-described method, and the average thereof was taken as the tensile strength. The true strain was obtained by calculating 2×ln (wire diameter of the wire rod/wire diameter of the drawn steel wire). "ln" is the natural logarithm, and the "wire diameter of the wire rod" is the wire diameter of the hot-rolled wire rod.

TABLE 3A

| Level | Wire rod | | | | | | | |
|---|---|---|---|---|---|---|---|---|
| | Area ratio of pro-eutectoid cementite (%) | Area ratio of intergranular ferrite, bainite, martensite, and residual γ (%) | Area ratio of pearlite (%) | Average thickness of pro-eutectoid cementite (μm) | Tensile strength TS (MPa) | TS* (MPa) | TS − TS* | Surface layer hardness HVs (HV) |
| A1 | 0.0 | 3.5 | 96.5 | 0.10 | 1174 | 1145 | 29 | 316 |
| A2 | 0.0 | 1.2 | 98.8 | 0.00 | 1228 | 1187 | 41 | 360 |
| A3 | 0.1 | 2.8 | 97.1 | 0.13 | 1225 | 1187 | 38 | 348 |
| A4 | 0.1 | 3.2 | 96.7 | 0.15 | 1146 | 1187 | −41 | 332 |
| A5 | 0.1 | 4.2 | 95.7 | 0.19 | 1157 | 1187 | −30 | 306 |
| A6 | 0.1 | 4.2 | 95.7 | 0.17 | 1234 | 1189 | 45 | 352 |
| A7 | 0.2 | 4.3 | 95.5 | 0.22 | 1227 | 1222 | 5 | 340 |
| A8 | 0.1 | 1.8 | 98.1 | 0.11 | 1254 | 1222 | 32 | 352 |
| A9 | 0.1 | 2.0 | 97.9 | 0.15 | 1228 | 1222 | 6 | 332 |
| A10 | 0.0 | 2.3 | 97.7 | 0.08 | 1258 | 1222 | 36 | 375 |
| A11 | 0.1 | 4.1 | 95.8 | 0.13 | 1276 | 1247 | 29 | 346 |
| A12 | 0.0 | 3.8 | 96.2 | 0.08 | 1228 | 1245 | −17 | 338 |
| A13 | 0.2 | 4.2 | 95.6 | 0.18 | 1169 | 1203 | −34 | 310 |
| A15 | 0.4 | 2.2 | 97.4 | 0.20 | 1310 | 1295 | 15 | 364 |
| A17 | 0.4 | 3.6 | 96.0 | 0.21 | 1254 | 1296 | −42 | 382 |
| A18 | 0.3 | 4.1 | 95.6 | 0.22 | 1278 | 1296 | −18 | 365 |
| A19 | 0.2 | 3.8 | 96.0 | 0.18 | 1264 | 1296 | −32 | 386 |
| A20 | 0.1 | 3.5 | 96.4 | 0.20 | 1245 | 1223 | 23 | 352 |
| A21 | 0.1 | 2.4 | 97.5 | 0.18 | 1247 | 1257 | −10 | 356 |
| A22 | 0.1 | 2.6 | 97.3 | 0.10 | 1239 | 1257 | −18 | 361 |
| A23 | 0.1 | 3.3 | 96.6 | 0.11 | 1253 | 1229 | 25 | 359 |
| A24 | 0.2 | 4.1 | 95.7 | 0.16 | 1298 | 1319 | −21 | 365 |
| A25 | 0.1 | 2.3 | 97.6 | 0.09 | 1238 | 1203 | 36 | 344 |
| A26 | 0.4 | 1.2 | 98.4 | 0.26 | 1241 | 1281 | −40 | 345 |
| A27 | 0.2 | 2.8 | 97.0 | 0.18 | 1277 | 1244 | 34 | 350 |

| Level | Wire rod | | Drawn wire rod evaluation results | | |
|---|---|---|---|---|---|
| | Central part hardness HVc (HV) | Formula (3) HVs − HVc | Wire diameter at which delamination occurred (mm) | True strain when delamination occurred | Note |
| A1 | 354 | −38 | 1.60 | 2.5 | Present Invention Example |
| A2 | 368 | −8 | 1.25 | 2.2 | Present Invention Example |
| A3 | 370 | −22 | 1.60 | 2.5 | Present Invention Example |
| A4 | 345 | −13 | 1.48 | 2.6 | Present Invention Example |
| A5 | 348 | −42 | 1.65 | 2.4 | Present Invention Example |
| A6 | 377 | −25 | 1.60 | 2.3 | Present Invention Example |
| A7 | 356 | −16 | 1.80 | 2.2 | Present Invention Example |
| A8 | 380 | −28 | 1.30 | 2.7 | Present Invention Example |
| A9 | 369 | −37 | 1.25 | 2.6 | Present Invention Example |
| A10 | 382 | −7 | 1.00 | 2.7 | Present Invention Example |
| A11 | 380 | −34 | 1.60 | 2.5 | Present Invention Example |
| A12 | 377 | −39 | 1.65 | 2.4 | Present Invention Example |
| A13 | 351 | −41 | 1.80 | 2.2 | Present Invention Example |
| A15 | 395 | −31 | 1.65 | 2.4 | Present Invention Example |
| A17 | 399 | −17 | 1.80 | 2.2 | Present Invention Example |
| A18 | 388 | −23 | 1.50 | 2.4 | Present Invention Example |
| A19 | 382 | 4 | 1.20 | 2.3 | Present Invention Example |
| A20 | 380 | −28 | 1.60 | 2.5 | Present Invention Example |
| A21 | 376 | −20 | 1.60 | 2.5 | Present Invention Example |
| A22 | 377 | −16 | 1.60 | 2.5 | Present Invention Example |
| A23 | 382 | −23 | 1.60 | 2.5 | Present Invention Example |
| A24 | 395 | −30 | 1.65 | 2.4 | Present Invention Example |
| A25 | 377 | −33 | 1.60 | 2.5 | Present Invention Example |
| A26 | 385 | −40 | 1.80 | 2.2 | Present Invention Example |
| A27 | 363 | −13 | 1.60 | 2.3 | Present Invention Example |

TABLE 3B

| Level | Wire rod: Area ratio of pro-eutectoid cementite (%) | Area ratio of intergranular ferrite, bainite, martensite, and residual γ (%) | Area ratio of pearlite (%) | Average thickness of pro-eutectoid cementite (μm) | Tensile strength TS (MPa) | TS* (MPa) | TS − TS* | Surface layer hardness HVs (HV) |
|---|---|---|---|---|---|---|---|---|
| A28 | 0.4 | 3.5 | 96.1 | 0.19 | 1341 | 1296 | 45 | 335 |
| A29 | 0.6 | 4.0 | 95.0 | 0.27 | 1278 | 1296 | −18 | 352 |
| A30 | 0.2 | 4.1 | 95.7 | 0.13 | 1270 | 1258 | 12 | 363 |
| A31 | 0.4 | 3.5 | 96.1 | 0.27 | 1315 | 1334 | −19 | 355 |
| A32 | 0.2 | 2.3 | 97.5 | 0.10 | 1302 | 1274 | 28 | 378 |
| A33 | 0.3 | 3.7 | 96.0 | 0.12 | 1242 | 1259 | −17 | 350 |
| A34 | 0.1 | 3.6 | 96.3 | 0.08 | 1255 | 1256 | −1 | 354 |
| A35 | 0.4 | 3.3 | 96.3 | 0.14 | 1288 | 1270 | 18 | 348 |
| A36 | 0.3 | 3.0 | 96.7 | 0.14 | 1297 | 1276 | 21 | 376 |
| A37 | 0.2 | 2.1 | 97.7 | 0.11 | 1296 | 1262 | 34 | 357 |
| A38 | 0.3 | 3.3 | 96.4 | 0.10 | 1267 | 1270 | −3 | 348 |

| Level | Wire rod: Central part hardness HVc (HV) | Formula (3) HVs − HVc | Drawn wire rod evaluation results: Wire diameter at which delamination occurred (mm) | True strain when delamination occurred | Note |
|---|---|---|---|---|---|
| A28 | 386 | −51 | 1.90 | 2.1 | Present Invention Example |
| A29 | 376 | −24 | 1.90 | 2.1 | Present Invention Example |
| A30 | 391 | −28 | 1.25 | 2.3 | Present Invention Example |
| A31 | 408 | −53 | 2.30 | 2.1 | Present Invention Example |
| A32 | 399 | −21 | 1.65 | 2.4 | Present Invention Example |
| A33 | 368 | −18 | 1.80 | 2.2 | Present Invention Example |
| A34 | 371 | −17 | 1.65 | 2.4 | Present Invention Example |
| A35 | 388 | −40 | 1.80 | 2.2 | Present Invention Example |
| A36 | 396 | −20 | 1.65 | 2.4 | Present Invention Example |
| A37 | 395 | −38 | 1.65 | 2.4 | Present Invention Example |
| A38 | 384 | −36 | 1.80 | 2.2 | Present Invention Example |

TABLE 3C

| Level | Wire rod: Area ratio of pro-eutectoid cementite (%) | Area ratio of intergranular ferrite, bainite, martensite, and residual γ (%) | Area ratio of pearlite (%) | Average thickness of pro-eutectoid cementite (μm) | Tensile strength TS (MPa) | TS* (MPa) | TS − TS* | Surface layer hardness HVs (HV) |
|---|---|---|---|---|---|---|---|---|
| B1 | 1.3 | 3.6 | 95 | 0.33 | 1435 | 1396 | 39 | 415 |
| B2 | 0.5 | 4.3 | 95 | 0.21 | 1256 | 1289 | −33 | 368 |
| B4 | 0.2 | 4.1 | 96 | 0.21 | 1228 | 1205 | 23 | 370 |
| B5 | 0.1 | 3.5 | 96 | 0.16 | 1355 | 1286 | 70 | 331 |
| B6 | 0.1 | 8.3 | 92 | 0.14 | 1297 | 1218 | 79 | 366 |
| B7 | 0.1 | 6.5 | 93 | 0.19 | 1409 | 1331 | 78 | 408 |
| B8 | 0.1 | 4.5 | 95 | 0.12 | 1312 | 1243 | 69 | 369 |
| B9 | 0.2 | 7.3 | 93 | 0.21 | 1348 | 1284 | 64 | 381 |
| B10 | 0.3 | 5.6 | 94 | 0.18 | 1181 | 1236 | −55 | 349 |
| B11 | 0.6 | 5.1 | 94 | 0.22 | 1205 | 1276 | −71 | 345 |
| B12 | 0.1 | 3.8 | 96 | 0.18 | 1223 | 1177 | 46 | 360 |
| B14 | 0.3 | 3.4 | 96 | 0.31 | 1236 | 1296 | −60 | 338 |
| B16 | 0.1 | 6.8 | 93 | 0.23 | 1371 | 1296 | 75 | 416 |
| B17 | 0.1 | 5.3 | 95 | 0.20 | 1238 | 1296 | −58 | 365 |
| B18 | 0.1 | 3.7 | 96 | 0.13 | 1247 | 1219 | 28 | 374 |

TABLE 3C-continued

| Level | Wire rod: Central part hardness HVc (HV) | Wire rod: Formula (3) HVs − HVc | Drawn wire rod evaluation results: Wire diameter at which delamination occurred (mm) | Drawn wire rod evaluation results: True strain when delamination occurred | Note |
|---|---|---|---|---|---|
| B1 | 432 | −17 | 2.50 | 1.6 | Comparative Example |
| B2 | 375 | −7 | 2.00 | 2.0 | Comparative Example |
| B4 | 378 | −8 | 1.80 | 2.0 | Comparative Example |
| B5 | 396 | −65 | 2.50 | 1.6 | Comparative Example |
| B6 | 386 | −20 | 2.50 | 1.6 | Comparative Example |
| B7 | 425 | −17 | 2.50 | 1.6 | Comparative Example |
| B8 | 396 | −27 | 2.20 | 1.8 | Comparative Example |
| B9 | 403 | −22 | 2.80 | 1.4 | Comparative Example |
| B10 | 355 | −6 | 2.50 | 1.6 | Comparative Example |
| B11 | 368 | −23 | 2.00 | 2.0 | Comparative Example |
| B12 | 364 | −4 | 2.50 | 1.6 | Comparative Example |
| B14 | 369 | −31 | 2.00 | 2.0 | Comparative Example |
| B16 | 403 | 13 | 2.50 | 1.6 | Comparative Example |
| B17 | 372 | −7 | 2.00 | 2.0 | Comparative Example |
| B18 | 380 | −6 | 2.00 | 2.0 | Comparative Example |

All Test Examples A1 to A38 were present invention examples, and all the hot-rolled wire rods showed excellent drawability that enabled wire-drawing without a patenting treatment and without the occurrence of delamination until the true strain reached 2.1.

On the other hand, Test Examples B1 to B18 did not satisfy any of the requirements of the present invention and thus were inferior in drawability.

B1 is an example in which the C content was high and the drawability decreased.

B2, B4, and B18 are examples in which the Si content was low and the ductility of the steel wire decreased.

B8 is an example in which [Si]+[Cr] (the total amount of Si and Cr) was high, the tensile strength of the wire rod became excessively large, and the ductility of the steel wire decreased.

B5 is an example in which the Si content and [Si]+[Cr] were high and the ductility of the steel wire decreased.

B6 is an example in which the Mn content and [Cr]+[Mn] were high, B7 is an example in which the high Cr content and [Si]+[Cr] were high, and B9 is an example in which the Mn content and [Cr]+[Mn] were high, the pearlite structure of the wire rod was low in amount, and the direct drawability decreased.

B10 is an example in which the Cr content was low, the pearlite structure was low in amount, and the direct drawability decreased.

B11 is an example in which [Cr]+[Mn] was low, the area ratio of pro-eutectoid cementite was increased, and the area ratio of pearlite was low, so that the direct drawability decreased.

B12 is an example in which the Cu content was high, defects were formed on the surface, and the ductility of the steel wire decreased.

B14 is an example in which the cooling rate 2 was low, the tensile strength TS of the wire rod decreased, and as a result, the direct drawability decreased.

B16 is an example in which the cooling rate 1 was high, the structure such as bainite was developed, the area ratio of pearlite decreased, the tensile strength TS of the wire rod increased, and as a result, the ductility of the steel wire decreased.

B17 is an example in which the cooling rate 3 was low, the tensile strength TS of the wire rod was low, and as a result, the direct drawability decreased.

INDUSTRIAL APPLICABILITY

According to the present invention, it is possible to provide a wire rod which contains C in an amount more than eutectoid steel and Si and Cr, is obtained without a heat treatment for reheating after hot rolling, does not cause delamination even with a high true strain, and thus has excellent direct drawability. Therefore, a wire rod of the present invention has high industrial applicability.

What is claimed is:

1. A hot-rolled wire rod comprising, as a chemical composition, by mass %:

C: 0.90% to 1.10%;
Si: 0.50% to 0.80%;
Mn: 0.10% to 0.70%;
Cr: 0.10% to 0.40%;
P: 0.020% or less;
S: 0.015% or less;
N: 0.0060% or less;
O: 0.0040% or less;
Al: 0.003% or less;
Ni: 0.50% or less;
Co: 1.00% or less;
Mo: 0.20% or less;
B: 0.0030% or less;
Cu: 0.15% or less;
Nb: 0.05% or less;
V: 0.05% or less;
Ti: 0.05% or less;
REM: 0.05% or less;
Mg: 0.05% or less;
Ca: 0.05% or less;
Zr: 0.05% or less;
W: 0.05% or less; and
a remainder including Fe and impurities,
wherein Formulas (1) and (2) are satisfied by mass %,
a structure of the hot-rolled wire rod consists of pearlite in an area ratio of 95.0% or more and a structure remainder in an area ratio greater than zero, the structure remainder consisting of pro-eutectoid cementite and, optionally, at least one of
intergranular ferrite,
bainite or martensite, and
retained austenite, and TS, which is a tensile strength in unit of MPa, and TS*, which is determined from a C content, a Si content, and a Cr content, satisfy Formula (3), $$0.50 \leq [Si]+[Cr] \leq 0.90 \quad (1)$$

$$0.40 \leq [Cr]+[Mn] \leq 0.80 \quad (2)$$

$$-50 < TS - TS^* < 50 \quad (3)$$

where the TS* is calculated by Formula (3'), $$TS^* = 1000 \times [C] + 100 \times [Si] + 125 \times [Cr] + 150 \quad (3')$$

in Formulas (1), (2) and (3'), [X] is an amount of an element X by mass %, wherein, in a case where a range from a center of the wire rod to R/5 when a circle equivalent radius of a cross section perpendicular to a longitudinal direction of the wire rod is R in unit of mm is defined as a central part, an average thickness of pro-eutectoid cementite is 0.08 μm to 0.25 μm in the central part.

2. The hot-rolled wire rod according to claim 1, wherein, in a case where a range from a surface to a depth of 200 μm is defined as a surface layer part and a range from a center of the wire rod to R/5 when a circle equivalent radius of a cross section perpendicular to a longitudinal direction of the wire rod is R in unit of mm is defined as a central part, HVs, which is a Vickers hardness of the surface layer part, and HVc, which is a Vickers hardness of the central part, satisfy Formula (4), $$-45 \leq HVs - HVc \leq 0 \quad (4).$$

3. The hot-rolled wire rod according to claim 1, wherein an area ratio of the pro-eutectoid cementite in the structure is 0.5% or less in the central part.

4. The hot-rolled wire rod according to claim 1, wherein a wire diameter of the hot-rolled wire rod is 3.0 to 6.0 mm.

5. The hot-rolled wire rod according to claim 2, wherein an area ratio of the pro-eutectoid cementite in the structure is 0.5% or less in the central part.

* * * * *